US007886909B2

(12) United States Patent
Robinson

(10) Patent No.: US 7,886,909 B2
(45) Date of Patent: Feb. 15, 2011

(54) METHOD AND APPARATUS FOR INDICATING DOSAGE TIME

(76) Inventor: Brett Robinson, 809 Burnett Ln., SE., Salem, OR (US) 97301

( * ) Notice: Subject to any disclaimer, the term of this patent is extended or adjusted under 35 U.S.C. 154(b) by 841 days.

(21) Appl. No.: 11/692,588

(22) Filed: Mar. 28, 2007

(65) Prior Publication Data

US 2008/0237177 A1 Oct. 2, 2008

(51) Int. Cl.
*B65D 83/04* (2006.01)

(52) U.S. Cl. ..... 206/534; 206/459.1; 206/459.5; 215/230; 215/365; 116/308

(58) Field of Classification Search ..... 215/230, 215/228, 365; 206/534, 459, 1, 459.5; 116/306, 116/308–311
See application file for complete search history.

(56) References Cited

U.S. PATENT DOCUMENTS 3,996,879 A * 12/1976 Walton ..... 116/308
4,347,804 A 9/1982 Villa-Real
4,913,083 A * 4/1990 Valvo et al. ..... 116/308
5,269,085 A * 12/1993 Chiapetta et al. ..... 40/311
5,386,795 A 2/1995 Bartholomew
5,433,324 A 7/1995 Leonard
5,482,163 A 1/1996 Hoffman
5,520,307 A 5/1996 Miller
5,645,534 A * 7/1997 Chanoch ..... 604/189
5,662,224 A * 9/1997 Nogues ..... 206/534
5,823,346 A 10/1998 Weiner
6,032,609 A 3/2000 Luoma
6,068,149 A * 5/2000 Telega ..... 215/230
6,073,356 A 6/2000 Li
6,311,840 B1 * 11/2001 Shrader ..... 206/459.1
6,789,497 B1 9/2004 Aiken
6,802,279 B1 10/2004 Johnson
7,017,513 B2 * 3/2006 Giewercer ..... 116/308
7,017,762 B2 3/2006 Shane
7,222,736 B1 * 5/2007 Seijas ..... 206/534
2002/0129758 A1 9/2002 Hanley et al.
2004/0216340 A1 * 11/2004 Woods ..... 40/311
2006/0124501 A1 6/2006 McNeely
2006/0180566 A1 * 8/2006 Mataya ..... 215/230

* cited by examiner

*Primary Examiner*—Sue A Weaver
(74) *Attorney, Agent, or Firm*—Whitham Curtis Christofferson & Cook, PC

(57) ABSTRACT

Medication packaging is designed with one or more of a container, cap, or externally applied ring which fits over the container having a polygonal peripheral side surface. Edges of the polygonal peripheral side surface assure that the packaging lays flat on a flat surface or is attached flat to a metal surface by magnetic forces. Indicia on one or more of the container, cap or externally applied ring is positioned when the user places the packaging on a flat surface such that at a predetermined location the previous dose or last dose is viewable by the user. Each indicia is associated with one edge of the polygonal peripheral side surface. A disk or sleeve member can be used to occlude indicia that is unrelated to the previous or next dose, and the disk or sleeve member can be operated by gravitational or magnetic forces without manipulation by the user.

16 Claims, 9 Drawing Sheets

METHOD AND APPARATUS FOR INDICATING DOSAGE TIME

BACKGROUND OF THE INVENTION

1. Field of the Invention

The present invention relates to a method and apparatus for indicating dosage time for medication. In particular, the invention is concerned with a method and apparatus for indicating a next or previous dosage time to comply with prescribed, or other recommended dosages, of medicines, supplements, vitamins, etc.

2. Background Description

It is common for people who are prescribed medication to either forget to take the medicine at the designated time, or fail to remember whether they have previously taken the medication. The same is true with respect to people who take non-prescribed dosages, such as vitamins, dietary supplements, etc.

To help those with such forgetful tendencies, reminder devices incorporated into medication containers have been developed. Such known medicine reminder devices require a user to actively set the reminder. For example, a user may have to move a window (see U.S. Pat. No. 5,383,795), or twist a knob or dial (see U.S. Pat. Nos. 5,433,324, 5,823,346 and 7,017,762) to set an indicator to a desired location.

However, the mechanisms employed by these reminder devices tend to be small and difficult to manage. This may be especially difficult for those with, for example, problems with their hands (e.g., arthritis, tendinitis, carpel tunnel, etc.) for which they could be taking the medicine. Furthermore, known medicine reminder devices can be confusing to a user and difficult to use due to the setting mechanisms and corresponding requirements of the user in order to accurately set the appropriate dosing time.

SUMMARY OF THE INVENTION

Accordingly, there is need for a dosage indicating method and apparatus that is easy to use, cost effective, and does not require active setting of an indicator.

It is an exemplary object of the present invention to provide a method and packaging for providing an indication of a next or previous dosage time for medication. The packaging includes a cap that is detachably attachable to a container which stores at least one dose of medication. The cap, container, or both, have a polygonal peripheral side surface, which must be the same size or larger than any other side surface of the cap and container. Further, the cap, container, or both, has a plurality of indicia that is associated with one edge of the polygonal peripheral side surface, where each of the indicia indicates a next or previous dosage time. In other words, each indicia is labeled around an outer circumference of the polygonal side surface so that only one indicia is on, adjacent to, or associated with one polygonal edge. Once the cap is secured to the container, the entire packaging is placed on a flat surface so that a selected edge of the polygonal peripheral side surface rests on the flat surface. When at rest on the flat surface, the indicia that indicates the next or previous dose is displayed at a predetermined position.

In an exemplary embodiment, the indicia may be on the top of the cap, and the predetermined position can be adjacent to an edge of the polygonal peripheral side surface that is opposite to the edge that rests on the flat surface. In an alternative exemplary embodiment, the indicia may be on a side of the container wherein the predetermined position is adjacent to an edge which is opposite the edge of the polygonal peripheral side surface that rests on the flat surface. As will be understood, a variety of configurations for indicia, the cap, and the container can be employed in the practice of the invention.

In the practices of the invention, at least one of, and possibly both, the cap and the container has a polygonal peripheral side edge. Preferably, the polygonal peripheral side surface has at least three sides (to designate morning, noon, and evening dosage times, for example) or at least seven or eight sides (to designate the days of the week, for example). The number of sides on the peripheral side surface of the cap or container can vary within the practice of the invention; however, it is preferred that the number of side edges be related to the dosage requirements for the medicament contained in the container, so that the user can easily relate the dosage time to how he or she lays the container on a flat surface (and/or affixes the container to a flat surface, such as, for example, by attaching the container to a refrigerator using a magnet).

Alternatively, in another exemplary embodiment, the packaging (e.g., the cap, or the container) can include, preferably, a weighted or magnetic disk rotatable under gravitational forces or magnetic attraction forces relative to an axes which passes through a center of the top of the cap or the container body. The weighted or magnetic disk would preferably cover all indicia except that which is indicative of the next or previous dose. Thus, no matter how the packaging is turned or twisted, the disk will be suspended so that, for example, the gravitational forces acting on the disk will cause a window, preferably large enough to show only one indicia, on the disk to, for example, point upward (the predetermined position). Alternatively, in the case of a magnetic disk, for example, the magnetic forces will cause a window, preferably large enough to show only one indicia, on the disk to, for example, point upward. Similarly, the packaging can include a rotating sleeve that rotates about an axis passing through the cap and container, where the sleeve preferably covers all indica except that which is indicative of the next or previous dose. In the case of the case of the sleeve, the rotation is preferably caused by gravitational and/or magnetic forces as described above for the disk.

It is another object of the present invention to provide a method and packaging for providing an indication of a next or previous dosage time for medication, which includes a ring securable around a circumference of the container. The ring has a polygonal peripheral side surface that is larger than any other side surface of the cap or the container. The ring may include a plurality of indicia, each of which is associated with one edge of the polygonal peripheral side surface that indicates a next or previous dosage time. Thus, once the cap is secured to the container and the ring is secured around the container, the entire packaging is placed on a flat surface so that a selected polygonal peripheral side surface rests on the flat surface. When at rest on the flat surface, the indicia that indicates the next or previous dose is displayed at a predetermined position. The ring might also be used in conjunction with indicia located on either or both the cap and the container.

As previously mentioned, existing dosage indicators can be difficult to operate and requires active setting of the indicators. With the present invention, all that is required of the user is to lay down the packaging on a flat surface, or affix container to a flat surface such as by magnetically attaching the container to a refrigerator or other metallic surface, so that the appropriate dosing time is displayed at the desired position (e.g., opposite the surface laying flat or at any other desired position).

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
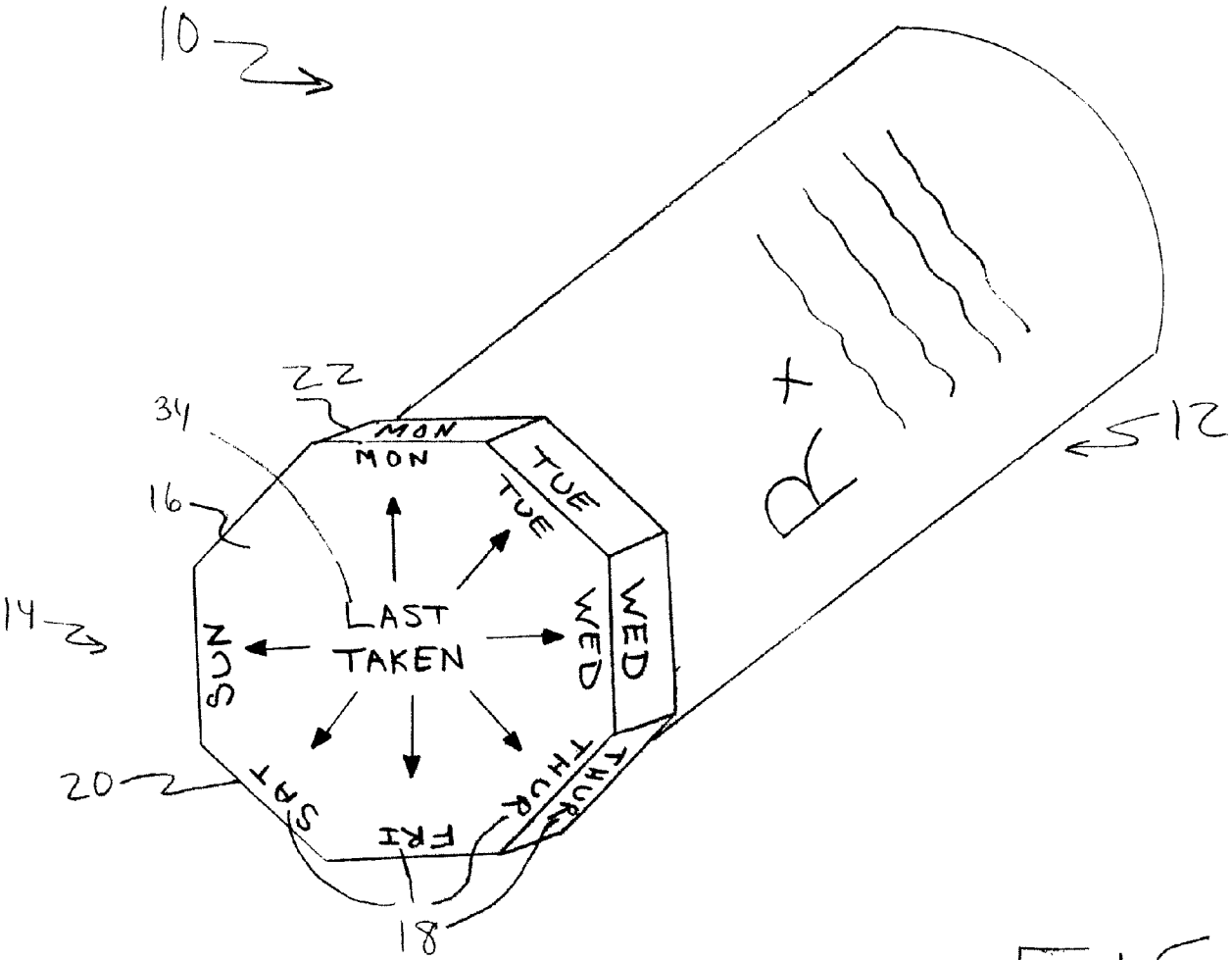
FIG. 1 is an isometric view of the medication packaging according to one embodiment of the present invention.
Figure 2A:
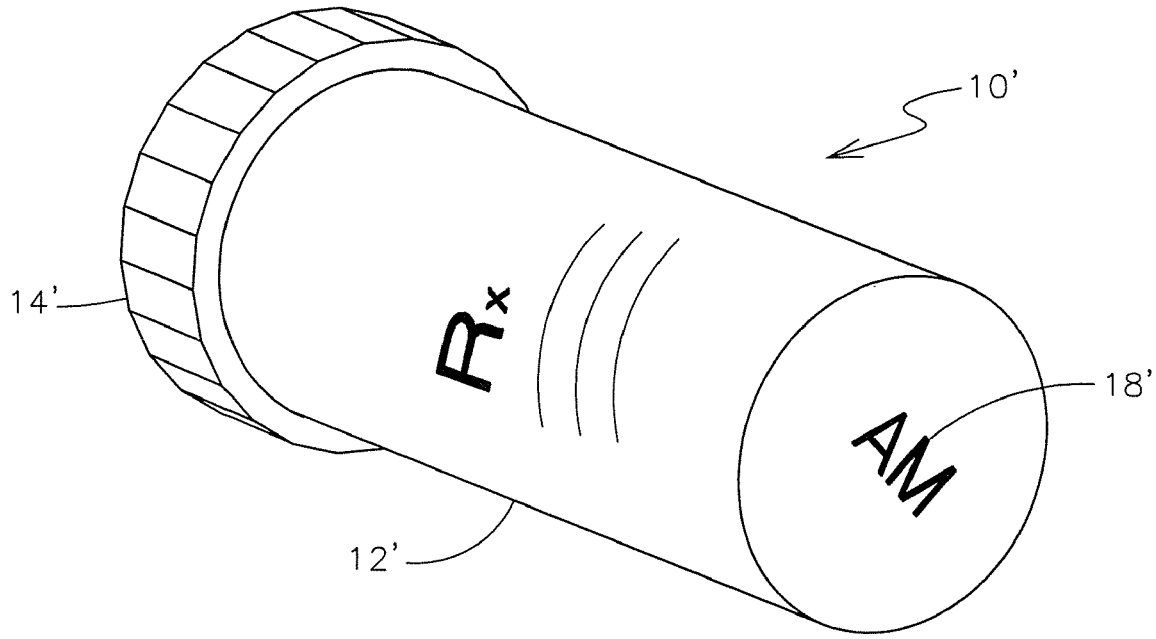
FIGS. 2A and 2B are isometric views of the medication packaging with a two-sided indicia according to the present invention.
Figure 2B:
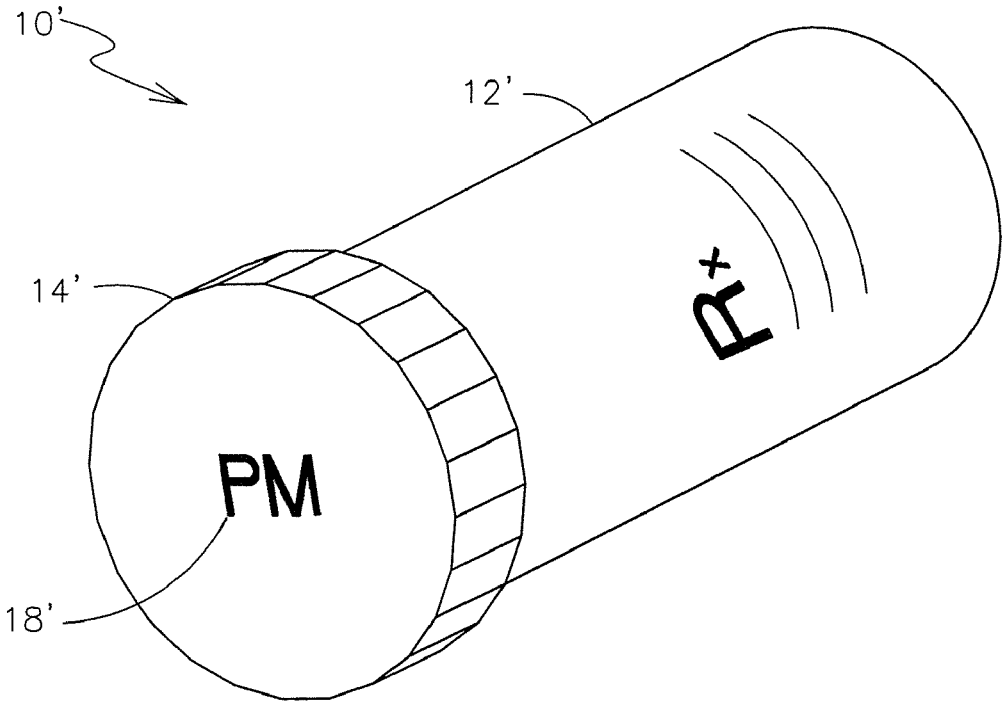
Figure 2:
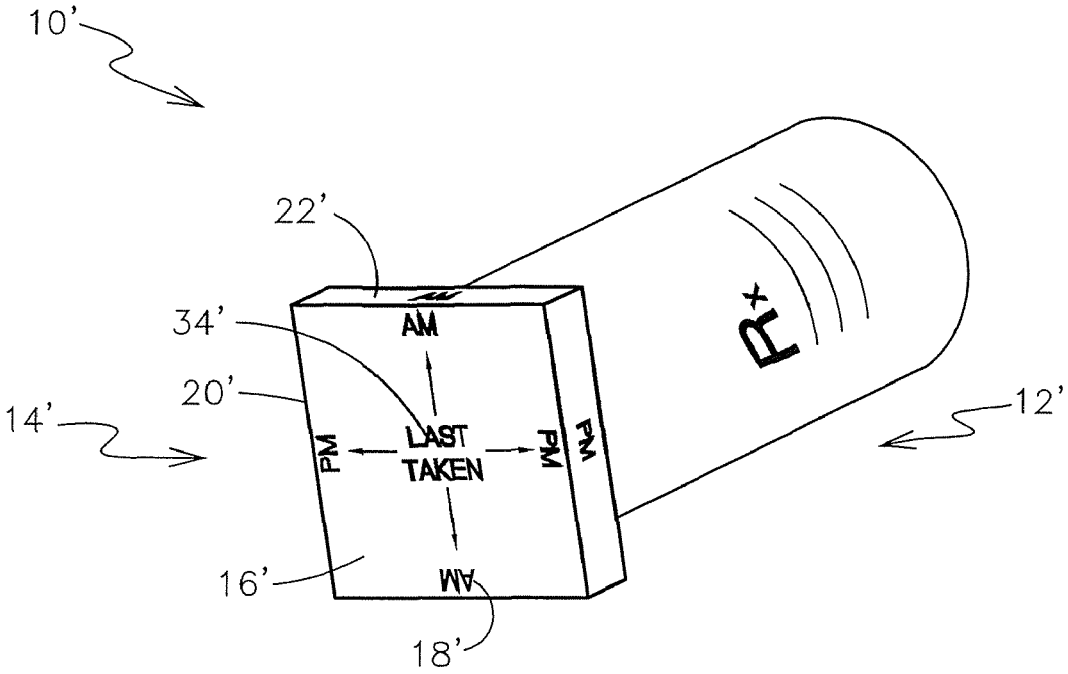
FIG. 2 is an isometric view of the medication packaging with a four-sided polygonal shaped cap according to the present invention.
Figure 3:
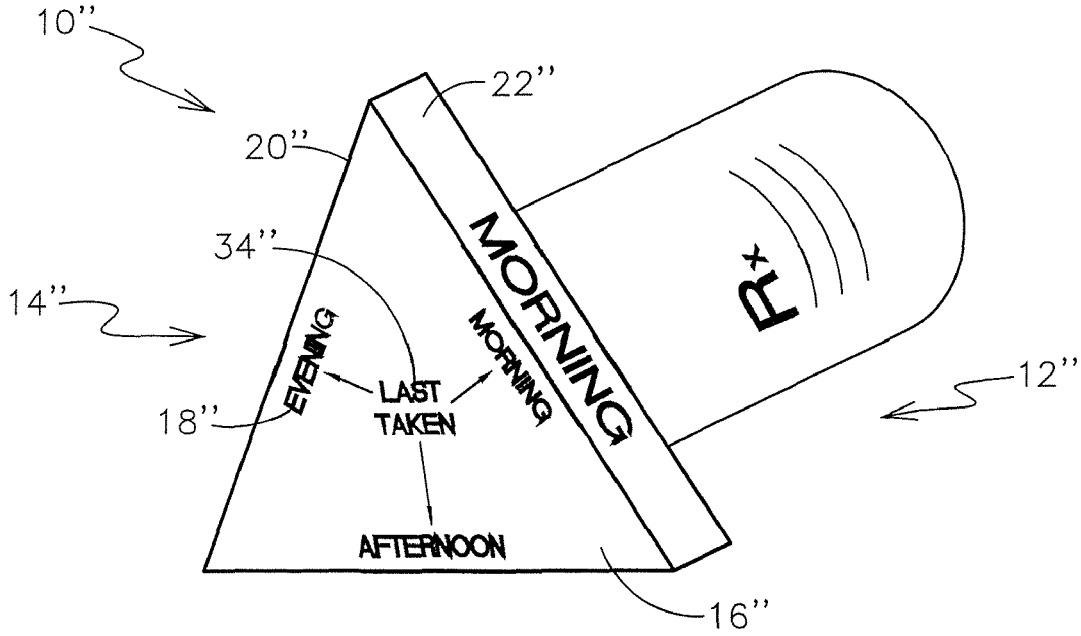
FIG. 3 is an isometric view of the medication packaging with a three-sided polygonal shaped cap according to the present invention.

Referring now to the drawings, and more particularly to FIGS. 1, 2 and 3, there are shown isometric views of the medication packaging 10, 10', and 10" with different polygonally-shaped caps 14, 14', and 14" attached to containers 12, 12', and 12". The caps 14, 14', and 14" can be attached to containers 12, 12', and 12" by known detachable-attachment methods (e.g., push-and-turn (bayonet), threading, etc.). FIGS. 1, 2 and 3 show the caps 14, 14', and 14" in polygonal forms of octagon, square, and triangle, respectively. Although the FIGS. 1-3 show the use octagon, square, and triangle shaped polygons, any kind of polygonal shape (e.g., rectangle, pentagon, hexagon, etc.) maybe used within the scope of the present invention. In a preferred embodiment, the number of edges of the polygonal side surface of the cap 14, 14', or 14" will be related to the dosage that is specified for the medicament in the container 12, 12', or 12".

FIGS. 1, 2 and 3 show the container 12, 12', and 12" as a tubular-shaped pill bottle; however, any kind of elongated pill container may be used within the scope of this embodiment of the present invention. However, in the practice of the embodiment shown in FIGS. 1-3, the polygonal peripheral side surface of the cap 14, 14', and 14" is the same size or larger than any other side surface of the cap 14, 14', or 14" or container 12, 12', or 12". This allows the container, for example, to rest in one position on a flat surface without rolling.

In the embodiments illustrated in FIGS. 1, 2 and 3, the cap 14, 14'or 14" is comprised of a polygonal peripheral side surface 16, 16'or 16", a plurality of indicia 18, 18' or 18", and a designation 34 that indicates whether a dosage was last taken. Although FIGS. 1, 2 and 3 show use of the designation "Last Taken", any designation of a next or previous dosage (e.g., taken, next dose, previous dose, etc.) may be used. The polygonal peripheral side surface 16, 16' or 16" includes a plurality of edges 20, 20' or 20". Preferably, adjacent to the polygonal peripheral side surface 16, 16' or 16", at an edge 20, 20' or 20", is a polygonal peripheral side edge 22, 22' or 22". In this embodiment, the diameter of the polygonal peripheral side surface 16, 16' or 16" of the cap 14, 14' or 14" is larger than the diameter of the attached container 12, 12' or 12". This allows for the container 10 to be kept in place while on a flat surface, as well as maintaining the predetermined position (which will be discussed in further detail below).

Each indicia 18, 18' or 18" is associated with one edge 20, 20' or 20" of the polygonal peripheral side surface 16, 16' or 16". As shown in FIG. 1, the indicia 18 includes, for example, the days of the week. Each day is labeled (or otherwise imprinted) next to one of the eight edges 20 of the polygonal peripheral side surface 16. In this example, since the days of the week only take up seven edges 20, the remaining edge can be for, for example, the trade name of the manufacturer of the medicament or bottle maker, the name of the medicament and dosing information, etc., or simply be left blank ( so that it might be filled in by the user, etc.).

FIGS. 2 and 3 show different indicia and different polygonally shaped caps 14' and 14". In FIG. 2, the cap 14' is in the form of a square with AM/PM indicia 18'. Although the indicia is shown as AM/PM, alternative indicia (e.g., morning, noon, afternoon, and evening) may be employed. Alternatively, FIGS. 2A and 2B show a two-sided AM/PM indicia where AM is designated on the bottom of the container 12' and the PM designated on the top of the cap 14'. Although the indica is AM/PM in the embodiment shown in FIGS. 2A and 2B, other types of indicia may be used (e.g., morning and evening). In FIG. 3, the cap 14" is in the form of a triangle with Morning, Afternoon and Evening indicia 18". Again, any indicia (e.g., breakfast, lunch, and dinner) may be used.

Further, as shown in FIGS. 1, 2 and 3, the each indicia 18, 18', or 18" can be labeled twice: once on the polygonal peripheral side surface 16, 16' or 16", and once on the polygonal peripheral side edge 22, 22' or 22". These dual-indicias are both labeled adjacent with one edge of the polygonal peripheral side surface 16, 16' or 16". Thus, a user can view his or her predetermined indicia from two different perspectives. Preferably, the predetermined position on the cap 14, 14' or 14" is adjacent to an edge of the polygonal peripheral side surface 16, 16' or 16" which is opposite to the edge that rests on or against a flat surface. For example, as shown in FIG. 1, the predetermined position would be Monday because it is opposite the edge on a flat surface. However, depending on the perspective of the user (e.g., sitting at a table), the predetermined position could be, for example, a 90° angle (e.g., Wednesday, as shown in FIG. 1). In other words, the predetermined position may be at the discretion of the user.

Figures 1A, 1B, 1C:
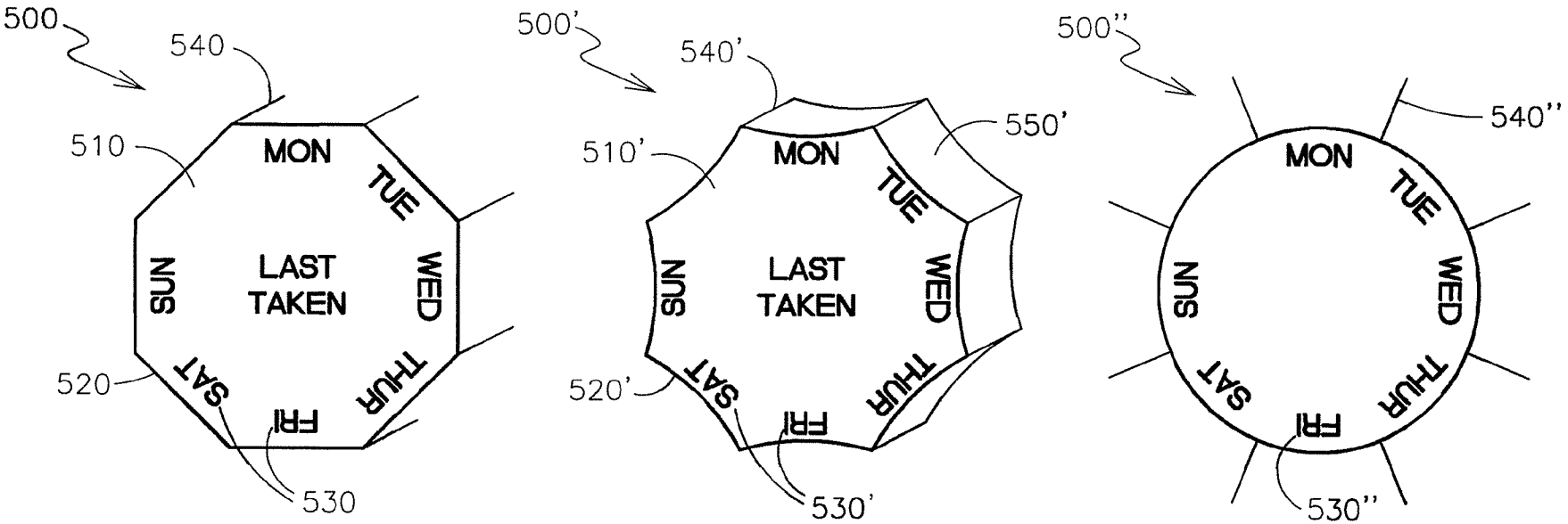
FIGS. 1A and 1B are isometric views of the alternative embodiments of the cap according to the present invention.
FIG. 1C is a front view of the cap according to an alternative embodiment of the present invention.

FIGS. 1A and 1B show alternative embodiments of the cap. Like in the previous embodiment, these Figures show the cap 500 or 500' with a polygonal peripheral side surface 510 or 510' with corresponding edge 520 or 520', along with indicia 530 or 530' associated with an edge 520 or 520'. However, FIG. 1A shows the cap 500 with projections 540 extending from each edge point of the polygonal peripheral side surface 510, which allows the packaging to be kept in place. Alternatively, FIG. 1B shows the cap 500' with a polygonal peripheral side edge 540' along with a corresponding concave surface 550'. The concave surface 550' allows the polygonal peripheral side edge 540' to remain elevated and, thus, prevents the packaging from moving. Although the alternative embodiments of the cap FIGS. 1A and 1B are shown in the shape of an octagon, other polygonal shapes may be used within the scope of this embodiment (e.g., triangle, square, etc.).

FIG. 1C shows another alternative embodiment of the cap. Particularly, the cap 500" shown in FIG. 1C is a standard circular cap for a pill bottle labeled with indicia 530" as discussed above. However, FIG. 1C shows a plurality of projections 540" extending outward in relation to the front of the cap 500". Thus, when the packaging is laid on a flat surface, the projections 540" prevent the packaging from moving or rolling. Further, the term "polygonal" as used in the embodiments shown in FIGS. 1A, 1B and 1C refers to the flat surface (i.e., polygonal peripheral side surface), the series of projections 540 or 540", and the polygonal peripheral side edge 540' with the concave surface 550'.

Figure 4:
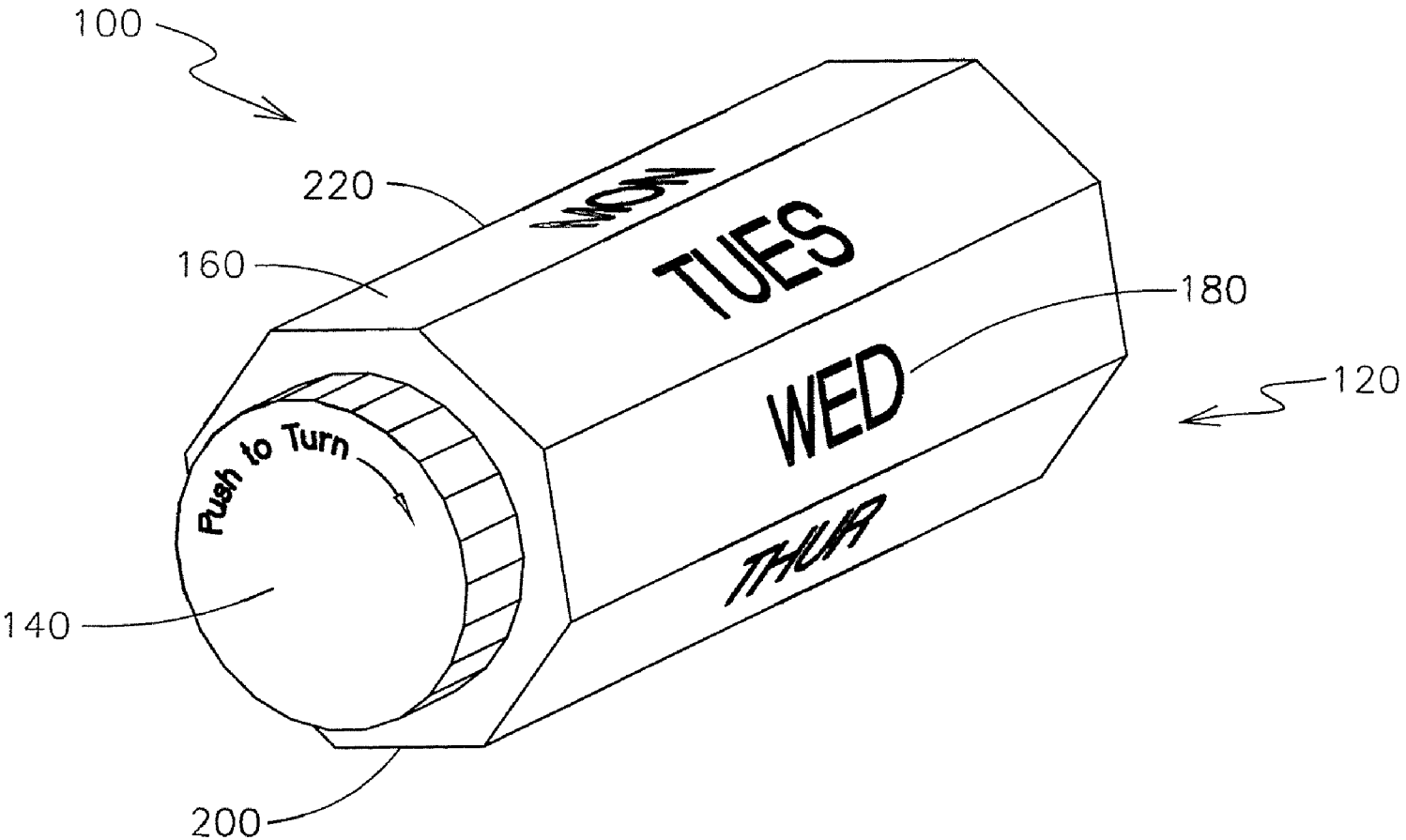
FIG. 4 is an isometric view of the medication packaging according to an alternative embodiment of the present invention.

Referring now to FIG. 4, there is shown an isometric view of medication packaging 100 with a polygonally-shaped container 120 according to an alternative embodiment. Although this embodiment shows the container in the shape of an octagon, any kind of polygonally-shaped container may be used within the scope of the present invention. As in the first embodiment, the cap 140 is attached to the container 120 by known detachable-attachment methods (e.g., push-and-turn, threading, etc.). However, in this embodiment, the diameter of the polygonal peripheral side surface 160 of the container 120 is the same size or larger than the diameter of the attached cap 140. This prevents the cap 140 from interfering with the movement of the medication packaging 100 when placed on or attached to a flat surface.

Each indicia 180 is associated with one edge surface 220 of the polygonal peripheral side surface 160 on the container 120. By way of example, FIG. 4 shows the indicia 18 to include the days of the week. Each day is labeled (or otherwise imprinted) on one edge surface 220, with the remaining edge surface to be used, for example, to label the product name. Preferably, the predetermined position on the container 120 is adjacent to an edge of the polygonal peripheral side surface 160 which is opposite to the edge on a flat surface. For example, as shown in FIG. 4, the predetermined position would be Monday because it is opposite the edge on a flat surface. However, depending on the perspective of the user (e.g., sitting at a table), the predetermined position could be, for example, a 90° angle (e.g., Wednesday, as shown in FIG. 4). In other words, the predetermined position may be at the discretion of the user.

Figure 5C:
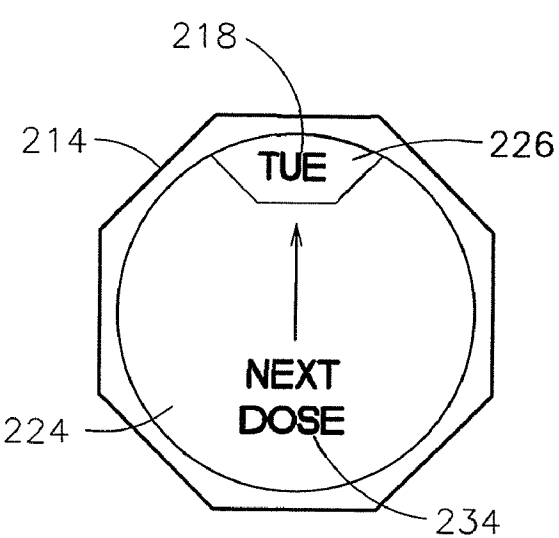
FIGS. 5*a*-5*c* show sequential movement of the rotatable disk according to the present invention.
Figure 5B:
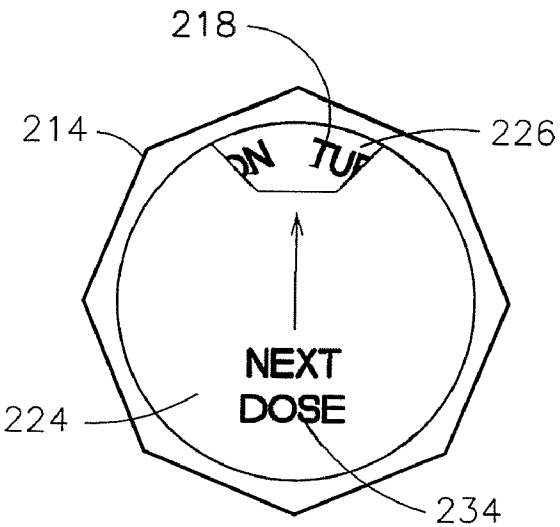
Figure 5A:
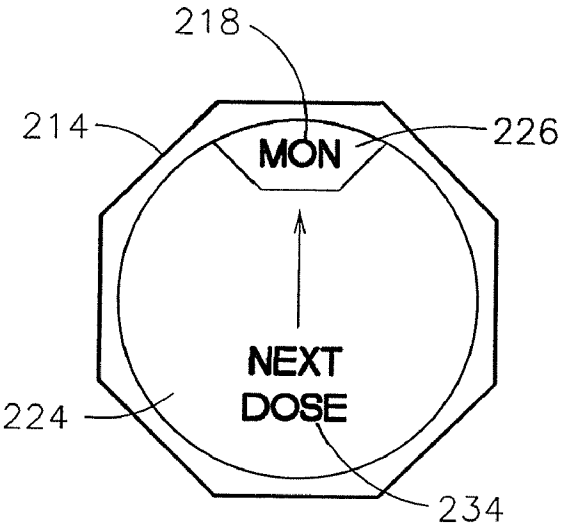

Referring now to FIGS. 5*a*-5*c*, there is shown sequential movement of the rotatable disk 224 according to another exemplary embodiment of the invention. In this embodiment, the disk 224 is pivotably attached to a top of the cap 214 so that the disk 224 is able to rotate around a diameter of the cap 214. The disk 224 includes a window 226 that allows a user to, preferably, view one indicia 218 while covering the remaining indicia (not shown). The remaining indicia are labeled around the outer diameter of the cap 214 (as, for example, addressed above in conjunction with FIG. 1). Further, the disk 224 is preferably weighted so as to be rotatable under gravitational forces, thus causing the window 226 to remain upward when the packaging is rested on a flat surface. Alternatively, the disk 224 could have a magnet (not shown) in the portion opposite the window 226 that would, under magnetic forces when the packaging is attached to a metal surface such as a refrigerator, cause the window 226 to remain outward from the metal surface. The disk 224 further includes a designation 234 of a next or previous dosage time (as noted above, the designation 234 can take a variety of forms "taken", "to be taken" ... the designation 234 may also be in the form of symbols). Although FIGS. 5*a*-5c show the use of a weighted or magnetic disk, other types of indicating apparatuses (e.g., a gravity-responsive arrow that points to the indicia, etc.) may be used within the scope of the present invention.

FIGS. 5*a*-5*c* show, by way of example, how the indicia is changed from Monday to Tuesday (i.e., to the predetermined position) by turning, rolling or twisting the medication packaging 214. Particularly, when a user turns, rolls or twists the packaging 214 (as when he or she is placing the packaging on a flat surface), the window 226 remains in an upward position while the indicia 218 turns with the packaging 214. Thus, the predetermined indicia of the next or previous dosage time is quickly and easily set with only minimal work required of the user.

Figure 6A:
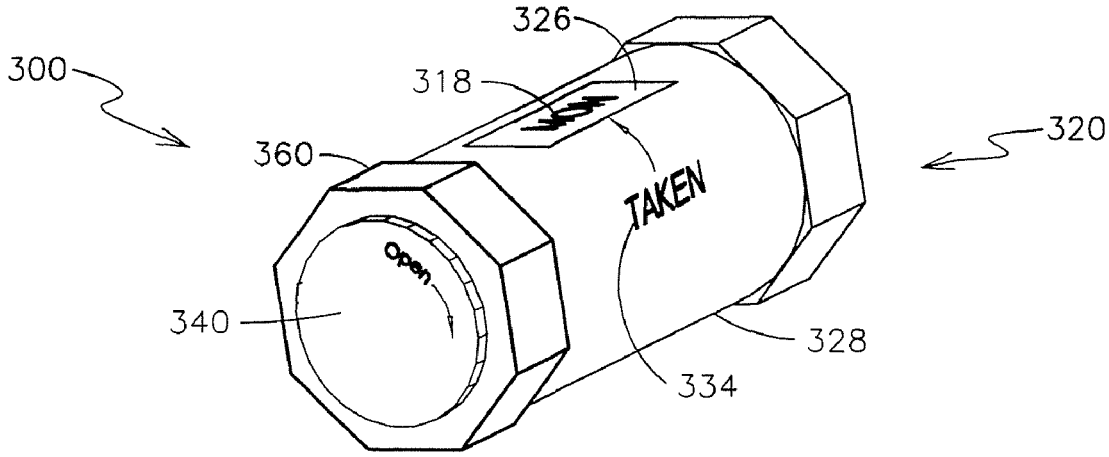
FIGS. 6*a*-6*c* show sequential movement of the rotating sleeve according to the present invention.
Figure 6B:
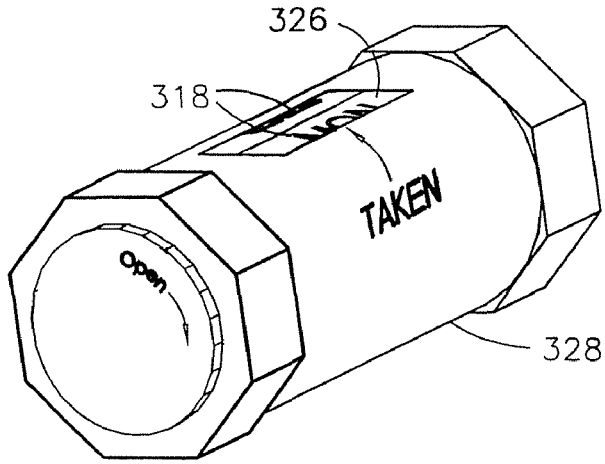
Figure 6C:
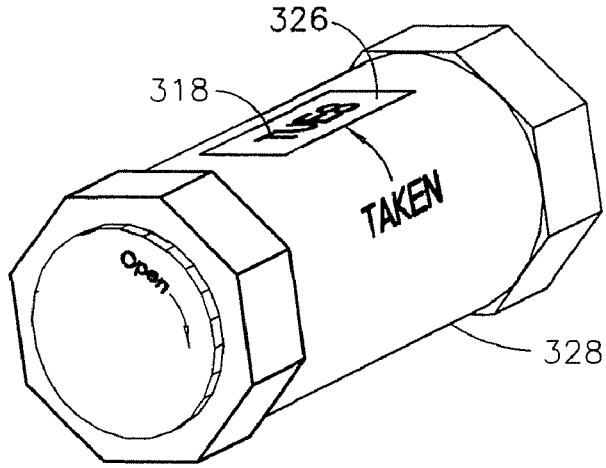

Referring now to FIGS. 6*a*-6*c*. there is shown sequential movement of a rotating sleeve 328 according to another embodiment of the invention. In this embodiment, the sleeve 328 is attached to the container 320 so that the sleeve 328 is able to rotate about an axis passing through the container 320. In the embodiment of FIGS. 6*a*-6*c*, the diameter of the sleeve 328 is slightly smaller than the diameter of the container 320 so as to not interfere with the movement of the container 320 when placed on a flat surface; however, this may not be required if the sleeve 328 is made of a deformable material. Like the rotatable disk discussed above, preferably the sleeve 328 includes a window 326 that allows a user to view one indicia 318, while the remainder of the sleeve 328 covers the remaining indicia (not shown). Further, the sleeve 328 is preferably weighted so as to be rotatable under gravitational forces, or magnetized on a side opposite the window 326, thus causing the window 326 to remain upward when laid on a flat surface or opposite a metal surface to which the packaging is attached. Like the rotatable disk discussed in FIGS. 5*a*-5*c*, when a user turns, rolls or twist the packaging 300, the window 326 remains, for example, in an upward position while the indicia 318 turns with the packaging 300. Thus, the predetermined indicia of the next or previous dosage time is quickly and easily set with only minimal work required of the user. Pills are obtained by turning the cap 340 clockwise as shown by the "open" arrow in FIG. 6*a*.

Although the embodiments shown FIGS. 5*a*-5*c* and 6*a*-6*c* show the window remaining upward, the window can be located in any viewable position (e.g., a 90° angle relative to a flat surface), and the weighting of the disk 234 or sleeve 328 can be adjusted so as to display the indicia 218 or 318 at any predetermined position.

Figure 7A:
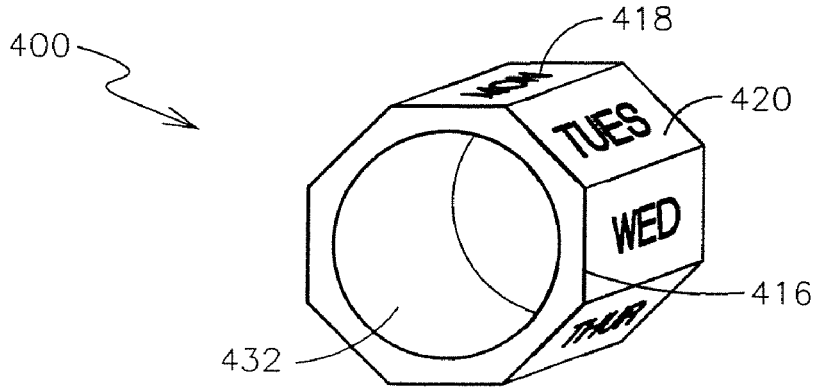
FIGS. 7*a*-7*c* show different embodiments of the ring member according to the present invention.
Figure 7B:
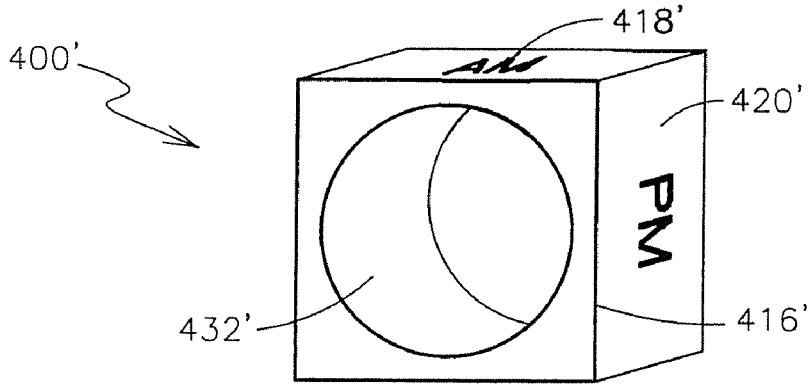
Figure 7C:
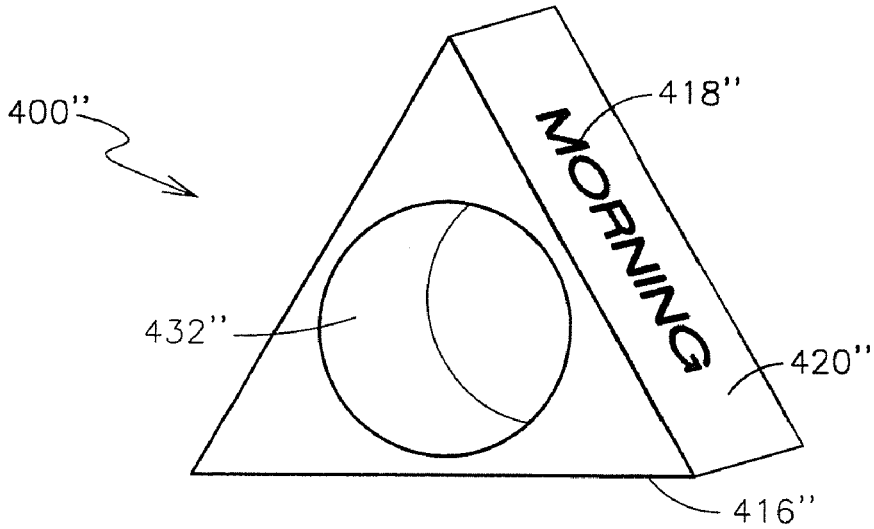

Referring now to FIGS. 7*a*-7*c*, there is shown yet another alternative embodiment of the present invention. In this embodiment, a polygonally-shaped ring 400, 400' or 400" is shown. Although the ring 400, 400' or 400" is shown in the shape of an octagon, square, and triangle (FIGS. 7, 7*b*, and 7*c*, respectively), any polygonal shape (e.g., hexagon, pentagon, etc.) may be used within the scope of the present invention. The ring 400, 400' or 400" includes a hole 432, 432' or 432" that passes through the center. The ring 400, 400' or 400" further includes a plurality of indicia 418, 418' or 418" that indicates a next or previous dosage time. Each indicia 418, 418' or 418" is associated with one edge surface 420, 420' or 420" of the polygonal peripheral side surface 416, 416' or 416".

Figure 8:
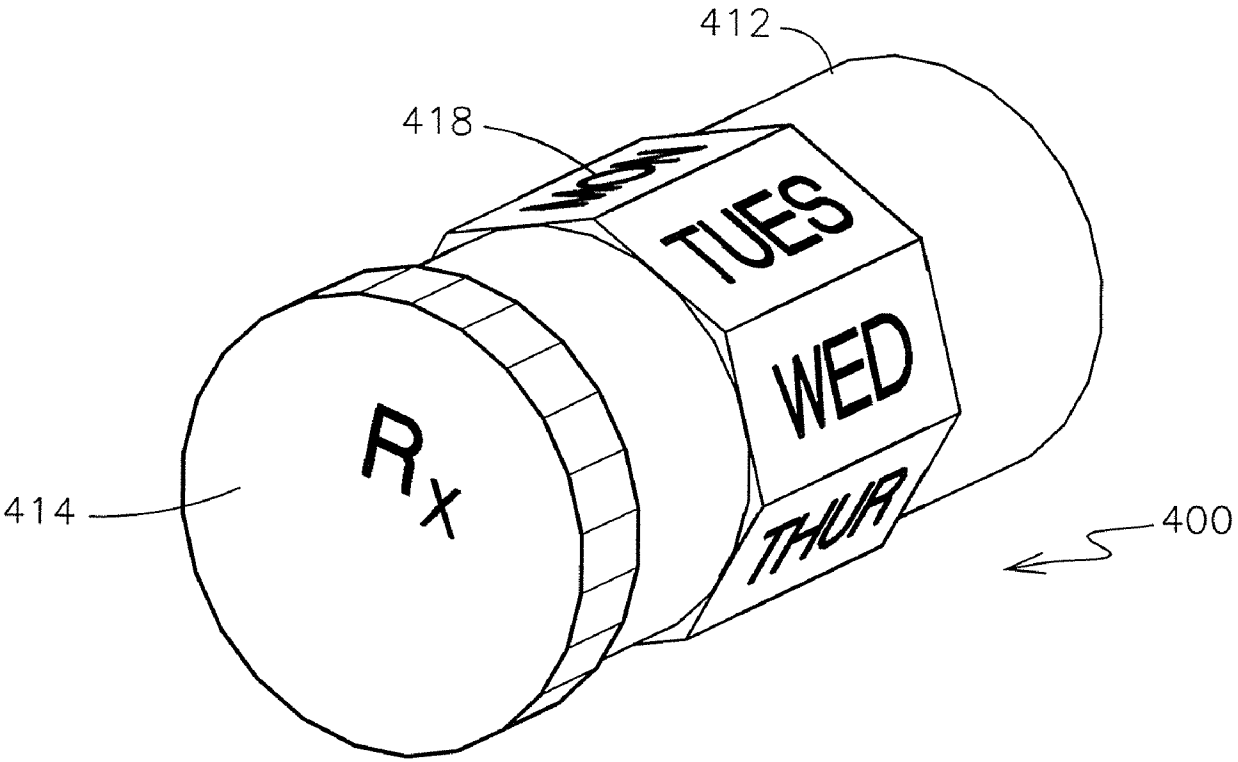
FIG. 8 shows the ring member encircling a standard pill bottle according to the present invention.

The ring 400 (400' or 400") is secured around any standard pill bottle. As shown in FIG. 8, a standard container 412 is inserted into the ring 400. The ring 400 may be constructed with a solid or elastic material (e.g., plastic, rubber, etc.). The ring's 400 diameter is the same size or larger than the diameter of the cap 414 and the container 412 so that neither the cap 414 or container 412 interferes with the movement of the entire packaging when placed on a flat surface.

The ring 400, 400' or 400" may also be used in combination with a cap 14, 14' or 14" as shown in FIGS. 1-3 or a polygonal container as shown in FIG. 4 and FIGS. 6*a*-6*c*.

While the invention has been described in terms of its preferred embodiments, those skilled in the art will recognize that the invention can be practiced with modification within the spirit and scope of the appended claims.

I claim:

1. A method for providing an indication of a next or a previous dosage time for medication, comprising the steps of:

securing a cap to a container which stores medication with at least one dose of said medication within said container, wherein at least one of said cap and said container has a polygonal peripheral side surface, wherein at least one of said cap and said container having a plurality of indicia each of which is associated with no more than one edge of said polygonal peripheral side surface, each of said indicia indicating a next or a previous dosage time and wherein indicia on adjacent side surfaces of said polygonal peripheral side surfaces are different from each other; and then placing said container with said cap secured thereto on a flat surface such that a selected edge of said polygonal peripheral side surface rests on said flat surface so as to display indicia indicative of said next dose or said previous dose at a predetermined position on at least one of said cap and said container.

2. The method of claim 1 wherein said indicia is on a top of said cap, and said predetermined position is adjacent to an edge of said polygonal peripheral side surface which is opposite to said edge on said flat surface.

3. The method of claim 1 wherein said indicia is on a side of said container, and said predetermined position is adjacent to an edge which is opposite said edge of said polygonal peripheral side surface which is on said flat surface.

4. The method of claim 1 wherein said cap has a polygonal peripheral side edge.

5. The method of claim 1 wherein said container has a polygonal peripheral side edge.

6. The method of claim 1 wherein said polygonal peripheral side surface has at least three sides.

7. The method of claim 1 wherein said polygonal peripheral side surface has at least eight sides.

8. The method of claim 1 wherein said indicia is on a top of said cap and further comprising a disk rotatable under gravitational forces relative to a top of said cap which covers all indicia except said indicia indicative of said next dose or said previous dose at said predetermined position.

9. The method of claim 1 wherein said indicia is on a side of said container and further comprising a rotating sleeve which rotates about an axis passing through said container and which covers all indicia except said indicia indicative of said next dose or said previous dose at said predetermined position.

10. The method of claim 1 wherein said at least one of said cap and said container has a polygonal peripheral side surface which is a same size or larger than any other side surface of said cap and said container.

11. A method for providing an indication of a next or a previous dosage time for medication, comprising the steps of:

securing a cap to a container which stores medication with at least one dose of said medication within said container, securing a ring around a circumference of said container, said ring having a polygonal peripheral side surface which is larger than any other side surface of said cap and said container, wherein at least one of said ring, said cap and said container having a plurality of indicia each of which is associated with no more than one edge of said polygonal peripheral side surface, each of said indicia indicating a next or a previous dosage time and wherein indicia on adjacent side surfaces of said polygonal peripheral side surfaces are different from each other; and then placing said container with said cap secured thereto on a flat surface such that a selected edge of said polygonal peripheral side surface rests on said flat surface so as to display indicia indicative of said next dose or said previous dose at a predetermined position on at least one of said ring, said cap, and said container.

12. Medication packaging, comprising:

a container which stores medication; and a cap which is selectively attachable to and detachable from said container so as to secure medication within said container or allows retrieval of said medication from said container, wherein at least one of said cap and said container has a polygonal peripheral side surface, at least one of said cap and said container having a plurality of indicia each of which is associated with no more than one edge of said polygonal peripheral side surface, each of said indicia indicating a next or a previous dosage time and wherein indicia on adjacent side surfaces of said polygonal peripheral side surfaces are different from each other, and wherein when said container with said cap secured thereto is placed on a flat surface, a selected edge of said polygonal peripheral side surface rests on said flat surface, and indicia indicative of said next dose or said previous dose is displayed at a predetermined position on at least one of said cap and said container.

13. The medication packaging of claim 12 further comprising disk rotatable under gravitational forces relative to a top of said cap which covers all indicia except said indicia indicative of said next dose or said previous dose at said predetermined position.

14. The medication packaging of claim 12 further comprising rotating sleeve which rotates about an axis passing through said container and which covers all indicia except said indicia indicative of said next dose or said previous dose at said predetermined position.

15. The medication packaging of claim 12 wherein said at least one of said cap and said container has a polygonal peripheral side surface which is a same size or larger than any other side surface of said cap and said container.

16. Medication packing, comprising:

a container which stores medication;

a cap which is selectively attachable to and detachable from said container so as to secure medication within said container or allows retrieval of said medication from said container; and a ring which is securable around a circumference of said container, said ring having a polygonal peripheral side surface which is larger than any other side surface of said cap and said container, wherein at least one of said ring, said cap and said container having a plurality of indicia each of which is associated with no more than one edge of said polygonal peripheral side surface, each of said indicia indicating a next or a previous dosage time and wherein indicia on adjacent side surfaces of said polygonal peripheral side surfaces are different from each other, and wherein when said container with said cap secured thereto is placed on a flat surface such that a selected edge of said polygonal peripheral side surface rests on said flat surface, indicia indicative of said next dose or said previous dose is displayed at a predetermined position on at least one of said ring, said cap, and said container.

* * * * *